United States Patent [19]

Holzer

[11] 4,366,852

[45] Jan. 4, 1983

[54] CORD WEIGHT ASSEMBLY

[75] Inventor: Joseph C. Holzer, Liverpool, N.Y.

[73] Assignee: Joanna Western Mills Company, Chicago, Ill.

[21] Appl. No.: 213,396

[22] Filed: Dec. 5, 1980

[51] Int. Cl.[3] ..... E06B 9/326; E05D 17/00

[52] U.S. Cl. ..... 160/320; 16/217

[58] Field of Search ..... 160/320; 16/DIG. 98, 16/216, 217, 218, 219

[56] References Cited

U.S. PATENT DOCUMENTS

| | | | |
|---|---|---|---|
| 64,976 | 5/1867 | Harvey | 16/217 |
| 201,109 | 3/1878 | Griffith et al. | 160/320 |
| 369,952 | 9/1887 | Matteson | 16/218 X |
| 886,653 | 5/1908 | Schwedtmen | 16/217 |
| 943,659 | 12/1909 | Detrick | 16/217 |

FOREIGN PATENT DOCUMENTS

| | | | |
|---|---|---|---|
| 39737 | 9/1973 | Australia | 16/219 |
| 708804 | 5/1965 | Canada | 160/320 |

*Primary Examiner*—Peter M. Caun
*Assistant Examiner*—Cherney S. Lieberman
*Attorney, Agent, or Firm*—Bean, Kauffman & Bean

[57] ABSTRACT

A cord weight assembly for drapes, blinds or the like having a generally cylindrical housing formed of two halves cooperating to define reversibly located end cavities in which a cord may be selectively, releasably attached and a central weight receiving cavity wherein the end cavities contain interfitting bosses and tubular members for securing the housing halves together and selectively engaging with the cord; and a resilient, deformable skirt fitted about the lower end of the housing and including a flexible flared base extending beyond the periphery of the housing for making non-damaging contact with adjacent structure in the event the cord weight assembly is swung out of its normally plumb position.

1 Claim, 4 Drawing Figures

CORD WEIGHT ASSEMBLY

SUMMARY OF THE INVENTION

The present invention relates to cord weights and more particularly, to a cord weight assembly for providing weighted tension to the draw cords of drapes, blinds and the like.

Although weighted devices are well known for maintaining draw cords in a relatively taut position, such cords are, nevertheless, subject to inadvertent movements or swinging which may be caused by any number of external forces such as wind through an open window or the like. Regardless of the causes of such movements, the same can cause damage to adjacent structure such as windows and walls, due to the impact of the weighted device thereagainst.

The foregoing problem is overcome according to the teachings of the present invention which provides a draw cord weight assembly so constructed and arranged as to prevent damage to adjacent walls and/or windows in the event of swinging contact therewith.

More specifically, the cord weight assembly of the present invention provides an elongated housing having end sections and a central section intermediate the end sections; means located in each of the end sections for selectively supporting a cord to be tensioned; a weight located in the central section; and a skirt fabricated of a resilient material and removably secured to the exterior of the housing selectively adjacent one of the end sections for cushioning contacts between the housing and adjacent structure in the event the housing is caused to swing into contact with such adjacent structure.

As will become apparent hereinbelow, according to a further feature of the present invention, the housing is formed of two identical halves, which are fitted together to define the end and central sections, and the skirt additionally functions to securely maintain the housing halves in their assembled, operative relationship.

BRIEF DESCRIPTION OF THE DRAWINGS

For a fuller understanding of the present invention reference should now be made to the following detailed description thereof, taken in conjunction with the accompanying drawings wherein.

DETAILED DESCRIPTION OF THE PREFERRED EMBODIMENT

Figures 1, 2, 3, 4:
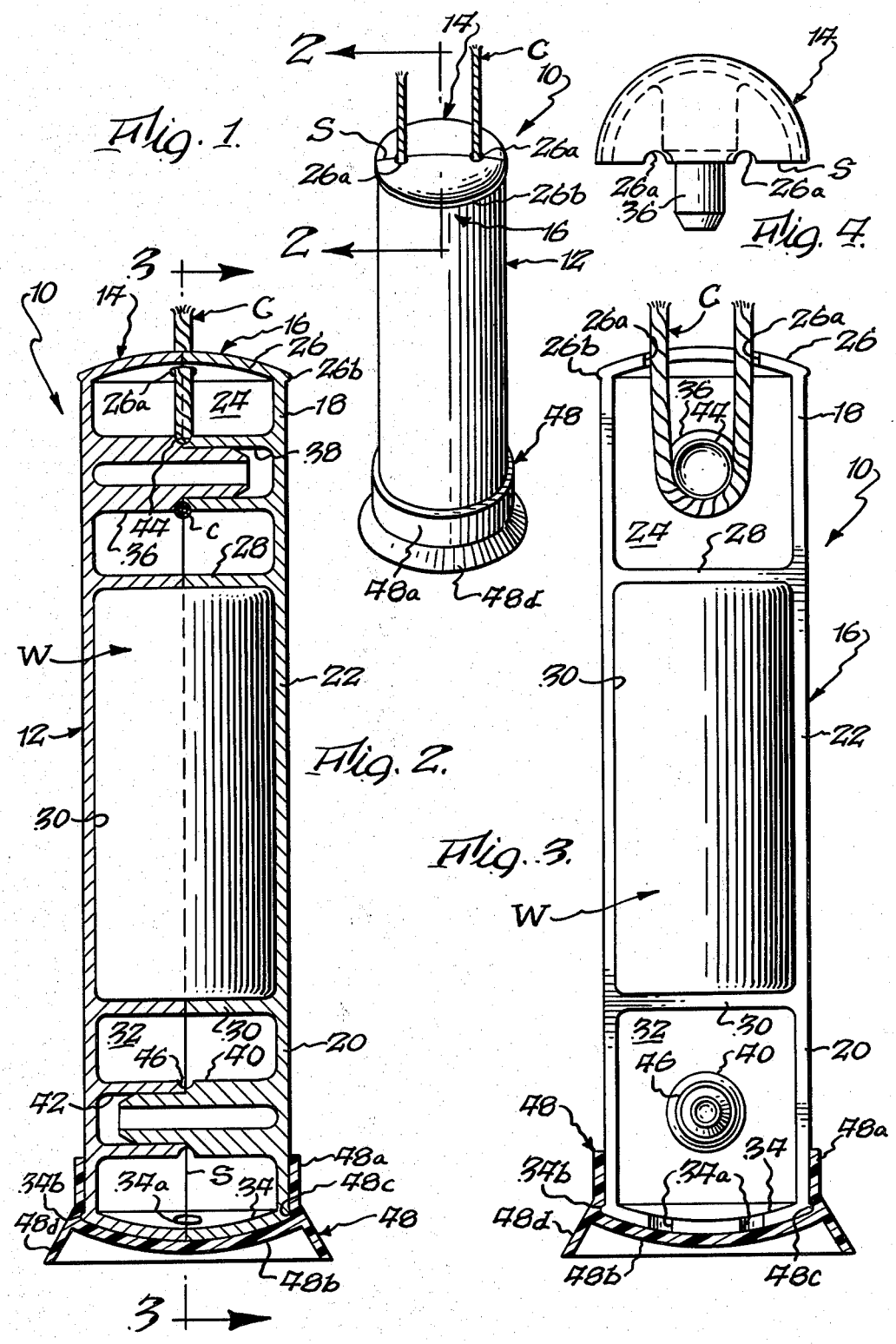
FIG. 1 is a perspective view of the cord weight assembly of the invention.
FIG. 2 is a sectional view taken along line 2—2 of FIG. 1.
FIG. 3 is a sectional view taken along line 3—3 of FIG. 2.
FIG. 4 is a plan or end view of one of the two complementary housing halves that comprise the housing for the cord weight of the invention.

Referring to the drawings, the cord weight assembly of the present invention is generally depicted at 10 and shown as comprising an elongated, generally cylindrical housing or casing 12 formed of two mating halves 14 and 16, which are of substantially identical construction and shiftable through 180° for the purpose of assembly in the manner to be described.

Housing 12 is comprised of three functional sections; namely, a pair of end sections 18 and 20, and an intermediate section or central section 22 located between the end sections. While end sections 18 and 20 are preferably functionally and structurally identical, they will now be referred to as upper and lower sections, respectively, as an aid to reference to FIGS. 1-3, wherein housing 12 is shown as depending vertically beneath looped cord "c". Upper section 18 defines an upper cavity 24, which is bounded by housing top or end wall 26, of substantially convex form, and an interior partition 28 between the upper and central sections 18 and 22, respectively. Central section 22 defines a central cavity 30 bounded by partition 28 at its upper end and by a similar interior partition 30 at its lower end. Lower section 20 defines a lower cavity 32 bounded by partition 30 at its upper end and a housing bottom wall 34 of substantially convex form at its lower end. The top wall 26 and the bottom wall 34 are of identical construction and are provided with a pair of spaced openings **26*a* and 34*a*, respectively and an annular peripheral lip or bead 26*b* and 34*b***, respectively.

As indicated earlier, housing 12 is formed of two complementary halves 14 and 16 and as such, one-half of walls 26 and 34, including one-half of the openings **26*a* and 34*b* and one-half of the annular lips 26*b* and 34*b*, and one-half of partitions 28 and 30 are formed as an integral part of half 14, whereas the other halves of each are formed as an integral part of half 16. These two halves 14 and 16 mate along the plane containing the seam "S" depicted in FIGS. 1, 2 and 4**.

Securing means is provided for by releasably joining halves 14 and 16 together in mating engagement. Such means is best shown in FIGS. 2 and 3 as being in the form of a transversely projecting boss 36 formed integrally with half 14 and preferably press or friction fitted into a transversely projecting tubular female member 38 formed integrally with half 16 within cavity 24. Such means also includes a similar boss 40 and mating tubular female member 42 arranged in lower cavity 32 and formed integrally with halves 16 and 14, respectively. It is to be noted that when the bosses and female members are in mating engagement, the outer peripheral adjacent surfaces thereof are so shaped as to provide annular guide or positioning channels 44 and 46, which are arranged in cavities 24 and 32, respectively, and bisected by the plane of seam "S". The arrangement illustrated in the drawings is such that cord "C" is attached to housing 10 by being passed through one of the openings **26*a*, around channel 44 and through the other of the openings 26*a*; the cord being normally tensioned or maintained substantially taut by a suitable weight "W" located within and essentially filling central cavity 30**.

To cushion housing 12 and prevent inadvertent swinging contacts thereof with adjacent structure, such as a window or wall surface, the lower section 20 is provided with a skirt or cushion device 48, which is formed from a resiliently deformable material. More specifically, skirt 48 comprises an upper, substantially cylindrical collar or sleeve portion **48*a* preferably closed at one end by a curved bottom wall 48*b*, which is substantially complementary in curvature to that of bottom wall 34; collar 48*a* being formed with an inwardly opening annular recess 48*c*, which is complementary in shape with lip 34*b* and arranged adjacent the juncture of collar 48*a* with bottom wall 48*b*. Skirt 48 additionally includes flexible outwardly flared or frusto-conically shaped base portion 48*d* arranged to extend from collar 48*a* radially outwardly beyond the cylindrical outer surface or periphery of housing 12 and axially downwardly beyond bottom wall 48***b*. The arrangement is such that the resilient skirt is securely but removably attached to lower section 20 of housing 12 with the recess 48*c* snap-fitted into engagement with annular lip 34*b* and the collar 48*a* disposed in surrounding relation to the lower section and preferably in snug or clamping engagement therewith. As will be apparent, the preferred construction of housing 12 illustrated in the drawings permits either of end sections 18 or 20 to be attached to or coupled with cord "C" with the other of such ends being attached to skirt 48.

Since the flared base portion 48*d* of the skirt extends beyond the housing 12, this portion will make contact with any adjacent structure, such as windows or walls, in the event cord weight assembly 10 is caused to swing sufficiently away from its normal plumb position. In this case the flexible and resilient nature of flared portion 48*d* will prevent marring or damage to such structure by simply flexing in response to any contact therewith.

It should be apparent that the skirt 48 may also perform the additional advantageous function of assisting the securing means described above in maintaining halves 14 and 16 in their assembled, operative relationship. In the absence of securing means of the type described, skirt 48 may be the sole means relied upon to releasably secure halves 14 and 16 in assembled condition.

The cord weight assembly may be fabricated of any suitable material as is well known to those skilled in the art. However, if the same is fabricated of a plastic material, it is clear that skirt 48 would be fabricated of a more resilient or softer material than the remainder of the assembly.

Although a preferred embodiment of the present invention has been disclosed and described, it is apparent that changes will obviously occur to those skilled in the art. It is therefore intended that the present invention is to be limited only by the scope of the appended claims.

What is claimed is:

1. A cord weight assembly of the type adapted to be attached to and depend from a cord for normally maintaining same in a taut condition, said assembly comprising:

a housing having an elongated construction including a cylindrical side wall and opposite convex end walls defined by two complementary halves arranged for mating engagement along a plane extending lengthwise of said housing, said halves having a pair of interior partitions cooperating with said side and end walls to define two end cavities each having a pair of spaced openings extending through one of said end walls of said housing and bisected by said plane and an intermediate cavity, said halves are secured together by means of a pair of bosses and a pair of tubular members frictionally interfitting with said bosses, said bosses and said tubular members extending transversely of said plane with one of said bosses and one of said tubular members being formed on each of said halves, each pair of frictionally interfitting bosses and tubular members being arranged within one of said end cavities and defining an annular channel bisected by said plane, said cord being selectively coupled to one of the ends of said housing by being passed through said pair of spaced openings extending through said end wall thereof and looped about said annular channel defined by the pair of interfitting bosses and tubular members arranged in said end cavity adjacent the last said end wall, and said halves cooperate to define a pair of annular lips disposed one adjacent each of said end walls and projecting radially outwardly of said wall;

a weight located within said intermediate cavity;

a skirt fabricated of a resiliently deformable material and removably secured to an opposite end of said housing remote from said one end for cushioning contacts between said housing and adjacent structure in the event said housing is caused to swing for contact therewith, said skirt including a cylindrical collar closed at one end thereof by a bottom wall substantially complementary in curvature to said end walls and having an inwardly opening annular recess arranged adjacent said bottom wall and a flexible outwardly flared base portion, said collar is sized to receive said side wall adjacent to said opposite end of said housing with the adjacently disposed one of said annular lips snap-fit received within said annular recess, and said flared base portion projects radially outwardly of said side wall and axially beyond said bottom wall.

* * * * *